US005634411A

United States Patent [19]

Chasan

[11] Patent Number: 5,634,411

[45] Date of Patent: Jun. 3, 1997

[54] TABLE TOP

[75] Inventor: Michael B. Chasan, Thornhill, Canada

[73] Assignee: Tablemedia Inc., Canada

[21] Appl. No.: 450,856

[22] Filed: May 25, 1995

[51] Int. Cl.[6] ..... A47B 3/06

[52] U.S. Cl. ..... 108/153; 108/27; 108/150

[58] Field of Search ..... 108/23, 25, 27, 108/90, 153, 150, 13, 11, 144, 147; 40/152

[56] References Cited

U.S. PATENT DOCUMENTS

| | | | |
|---|---|---|---|
| 1,676,440 | 7/1928 | Jackson | 108/23 |
| 2,113,049 | 4/1938 | Holland | 108/23 X |
| 3,802,708 | 4/1974 | Libert | 108/23 X |
| 4,624,598 | 11/1986 | Gabriel et al. | 108/150 X |
| 4,724,773 | 2/1988 | Newberry et al. | 108/150 |
| 4,905,611 | 3/1990 | Jung-Chung | 108/153 X |
| 5,066,078 | 11/1991 | Wurst . | |
| 5,404,828 | 4/1995 | Tesney | 108/27 |
| 5,436,048 | 7/1995 | Meier et al. | 108/27 X |

FOREIGN PATENT DOCUMENTS

| | | | |
|---|---|---|---|
| 2276649 | 1/1976 | France . | |
| 2294666 | 7/1976 | France . | |
| 2723195 | 12/1977 | Germany | 108/23 |
| 524105 | 7/1940 | United Kingdom . | |

*Primary Examiner*—Jose V. Chen
*Attorney, Agent, or Firm*—Ladas & Parry

[57] ABSTRACT

A table has a transparent cover with a retaining ring to hold the cover in place. Advertising material may be inserted between the cover and table so as to be protected during use of the table.

18 Claims, 1 Drawing Sheet

TABLE TOP

The present invention relates to tables. Tables are widely used in the restaurant and food industry and typically may carry advertising in the form of placemats or free-standing flyers. These are intended to attract the attention of the patron of the establishment while being served and therefore provide a valuable advertising opportunity.

In such arrangements, however, the advertising material is loose and therefore is liable to be lost or damaged. Moreover, the loose advertised materials are a source of litter that can detract from the ambiance of the restaurant. The advertisers attach great importance to the quality of the advertising material and therefore prefer not to see damage or spoiled advertisements for their products.

It is therefore an object of the present invention to provide a table which may accommodate advertising material and avoid the above problems.

In general terms, the present invention provides a table having a table top with a generally planar upper surface and a skirt depending from its periphery. A support, such as legs, maintains the table top in an elevated position. A transparent cover extends across the upper surface and terminates adjacent to the periphery with a retaining ring extending about the periphery to retain the cover on the upper surface. The ring has a first limb extending inwardly from the periphery to overlap a marginal edge of the cover and a second limb extending normal to the first limb to overlap the skirt. Releasable retainers are provided to secure the ring to the table top.

Advertising material may then be inserted between the cover and the upper surface where it is protected by the transparent cover.

In a preferred embodiment, seals are provided between the retaining ring and the cover to inhibit the ingress of the fluids and maintain the quality of the advertising image.

The retaining ring is readily removed to release the advertising material and permit it to be replaced with a different advertisement from time to time.

An embodiment of the present invention will now be described by way of example only with reference to the accompanying drawings, in which FIG. 1 is a perspective view of a table carrying advertising material;

Figure 1:
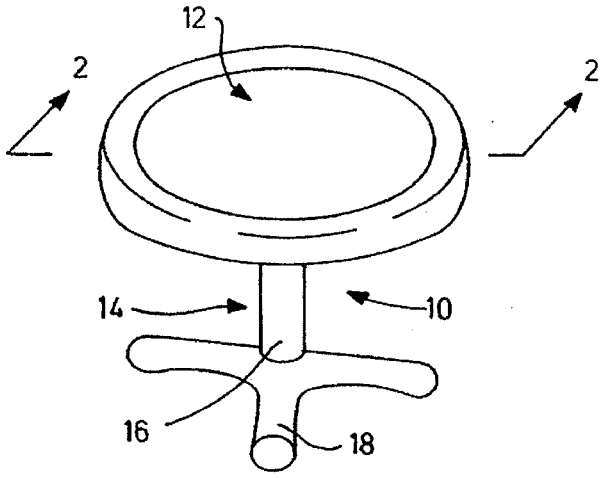

Referring therefore to FIG. 1, a table generally indicated 10 has a table top 12 and a support 14. Support 14 can be of any convenient form and in the embodiment shown has a central pillar 16 with radial legs 18 at the lower end. Other forms of support 14 may of course be utilized, including three or more separate legs.

Figure 2:
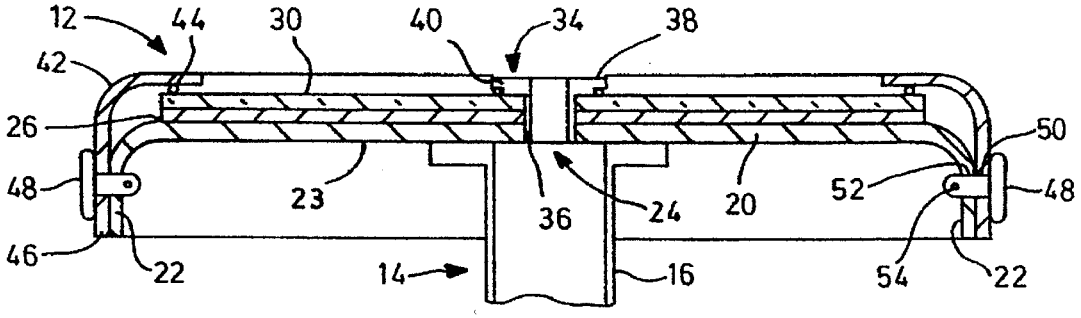
FIG. 2 is a section on the line 2—2 of FIG. 1 on an enlarged scale.
Figure 3:
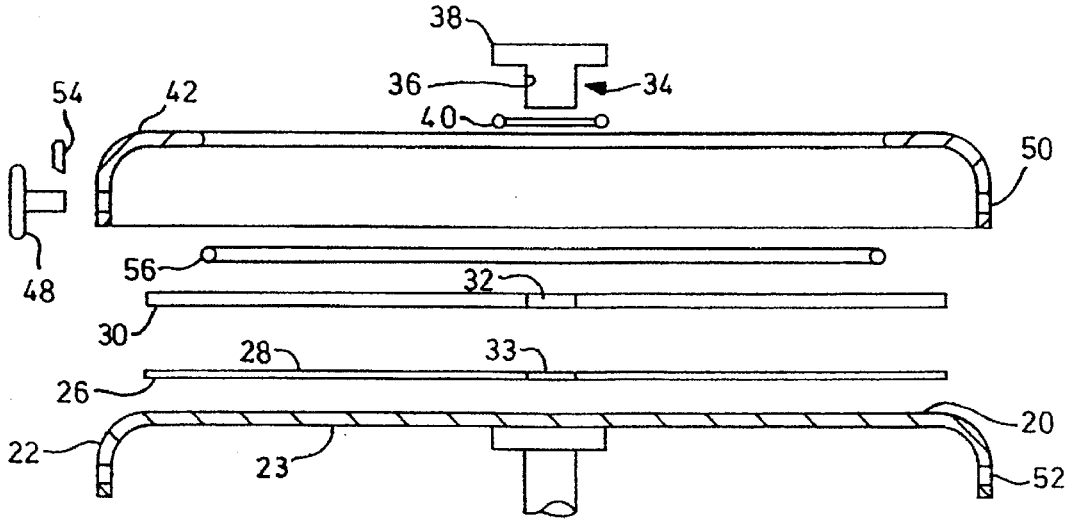
FIG. 3 is a view similar to FIG. 2 with the components exploded from one another to show the construction of the table of FIG. 1.

As can best be seen in FIG. 2, the top 12 includes a planar upper surface 20 that terminates in a skirt 22 at its periphery. The pillar 16 is secured to the underside 23 of the top 12 in a convenient manner. A central hole 24 is formed in the top 12 to receive an umbrella or the like as is conventional and need not be described further.

A substrate 26, typically paper or plasticized paper, is located on the top 12 to extend to the skirt 22. The substrate 26 will have advertising material printed on the upper surface 28 which is covered by a transparent cover 30. Cover 30 may be glass or clear plastic depending upon the particular application. Both the cover 30 and the substrate 26 have central apertures 32,33 respectively that are slightly larger than the hole 24. A sleeve 34 having a cylindrical body 36 and a radial flange 38 is received in the hole 24 with the flange 38 overlapping the cover 30. An O-ring seal 40 is positioned beneath the flange 38 to seal between the cover 30 and the sleeve 34. The sleeve 34 is preferably a friction fit within the hole 24 so as to be retained when in use.

A retaining ring 42 is located at the periphery of the top 12 and conforms generally to the shape of the top 12. The ring 42 is typically molded from a plastic material as one piece. The retaining ring 42 has a radial limb 44 that extends inwardly to overlap the outer edge of the cover 30 and substrate 26. The retaining ring 42 also includes an axial limb 46 which extends over the skirt 22. The ring 42 is dimensioned so as to be nested snugly with the skirt 22 when the radial limb 44 is engaging the cover 30.

The ring 42 is retained on the skirt 22 by fasteners 48 that pass through aligned holes 50,52 in the ring 42 and skirt 22 respectively. A pin 54 holds the fasteners 48 in location to prevent the ring 42 from axial movement. A seal 56 is positioned between the limb 44 and cover 30 to prevent the ingress of moisture to the edge of the substrate 26.

To insert advertising material in the table 10, the ring 42 is removed by release and withdrawal of the fasteners 48 and the cover 30 removed. The substrate 26 may then be positioned on the upper surface 28 and the cover 30 replaced. Sleeve 34 may then be inserted into the central hole 24 to centralize the cover and the substrate.

The retaining ring 42 may then be positioned so that the holes 50,52 are aligned and the fasteners 48 inserted so as to be retained by the pin 54.

The substrate 26 may be printed with high quality graphics showing the advertising material or logo of a sponsor with the graphics being protected from spoilage by the transparent cover 30. The seals 40,56 prevent spillage from affecting the substrate and so maintain the quality of the advertised material over a significant period. At the same time, the advertising material may be absorbed by patrons of the restaurant so that a constant advertising message is provided.

It will be apparent that the shape of the table 10 may vary to suit different configurations and can be circular, square, octagonal or any convenient shape. The ring 42 may be molded to conform to the periphery of the table. Similarly, the seals 40,56 may be integrally formed with the flange 38 and limb 44 to facilitate installation of the ring 42.

I claim:

1. A table comprising a table top having a generally planar upper surface with a skirt depending from a periphery thereof, a support to maintain said table top in an elevated position, a transparent cover to extend across said upper surface and terminate adjacent said periphery, a retaining ring to retain said cover on said surface, said ring conforming to the periphery of said top and having a first limb extending inwardly from the periphery to overlap a marginal edge of said cover and a second limb extending normal to said first limb to overlap said skirt, and releasable retainers to secure said ring to said tabletop, and wherein a hole is provided in said table top at the center thereof and a corresponding aperture is provided in said cover.

2. A table according to claim 1 wherein said releasable retainers extend between said second limb and said skirt.

3. A table top according to claim 2 wherein said releasable retainers include a plurality of pegs each engageable with a respective one of a plurality of holes circumferentially spaced about said skirt.

4. A table top according to claim 1 wherein a seal is located between said first limb and said cover.

5. A table according to claim 1 wherein a sleeve extends through said aperture and said hole.

6. A table according to claim 5 wherein a seal is provided between said sleeve and said cover.

7. A table according to claim 1 wherein a flexible substrate is located between said upper surface and said cover, said substrate having an upper surface having information carried thereon.

8. A table according to claim 7 wherein said substrate has a shape complementary to said tabletop.

9. A table according to claim 8 wherein a seal is provided between said retaining ring and said cover.

10. A table according to claim 8 wherein an aperture is provided in said substrate corresponding to said aperture in said cover.

11. A table according to claim 10 wherein a sleeve extends through said apertures and said hole and a seal is provided between said sleeve and said cover.

12. A table according to claim 12 wherein a seal is provided between said retaining ring and said cover.

13. A table according to claim 12 wherein said releasable retainers extend between said second limb and said skirt.

14. A table according to claim 13 wherein said releasable retainers include a plurality of pegs each engageable with a respective one of a plurality of holes circumferentially spaced about said skirt.

15. A table comprising a table top having a generally planar upper surface, a support to maintain said table top in an elevated position, a flexible substrate extending across said table top and having an undersurface in engagement with and supported by said planar upper surface and an oppositely directed surface having information disposed thereon, said substrate extending adjacent a peripheral edge of said top so as to cover substantially said planar upper surface, a transparent cover extending across said oppositely directed surface to provide protection therefor and a retainer extending about said peripheral edge and securing said cover to said table top, said retainer being releasably connected to said table top to facilitate removal of said cover and replacement of said substrate on a periodic basis and wherein a hole is provided in said table top at the center thereof and corresponding aperture is provided in said cover and said substrate.

16. A table according to claim 15 wherein a seal is provided at said aperture to protect an edge of said substrate adjacent said aperture.

17. A table according to claim 15 wherein said information carried by said oppositely directed surface is advertising material.

18. A table according to claim 12 wherein said substrate is a paper.

* * * * *